US006861193B1

(12) United States Patent
Golodetz

(10) Patent No.: US 6,861,193 B1
(45) Date of Patent: Mar. 1, 2005

(54) FLUORESCENT LIQUID TONER AND METHOD OF PRINTING USING SAME

(75) Inventor: Galia Golodetz, Rehovot (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 10/276,342

(22) PCT Filed: May 17, 2000

(86) PCT No.: PCT/IL00/00277

§ 371 (c)(1),
(2), (4) Date: Nov. 14, 2002

(87) PCT Pub. No.: WO01/88619

PCT Pub. Date: Nov. 22, 2001

(51) Int. Cl.[7] ..... G03G 9/09

(52) U.S. Cl. ..... 430/114; 430/110.1; 430/110.3; 430/137.18; 430/137.19

(58) Field of Search ..... 430/114, 110.1, 430/110.3, 137.18, 137.19

(56) References Cited

U.S. PATENT DOCUMENTS

| | | | |
|---|---|---|---|
| 3,718,155 | A | 2/1973 | Suzuki et al. |
| 3,863,603 | A | 2/1975 | Buckley et al. |
| 3,869,397 | A | 3/1975 | Tellier |
| 3,893,761 | A | 7/1975 | Buchan et al. |
| 3,937,177 | A | 2/1976 | Lloyd |
| 3,959,574 | A | 5/1976 | Seanor et al. |
| 4,204,766 | A | 5/1980 | Harada |
| 4,207,102 | A | 6/1980 | Dessauer |
| 4,222,497 | A | 9/1980 | Lloyd et al. |
| 4,286,039 | A | 8/1981 | Landa et al. |
| 4,289,092 | A | 9/1981 | McChesney et al. |
| 4,310,238 | A | 1/1982 | Mochizuki et al. |
| 4,439,035 | A | 3/1984 | Landa |
| 4,480,907 | A | 11/1984 | Vackier |
| 4,579,253 | A | 4/1986 | Shenier |
| 4,634,252 | A | 1/1987 | Jeremijevic |
| 4,678,317 | A | 7/1987 | Grossinger |
| 4,684,238 | A | 8/1987 | Till et al. |
| 4,690,539 | A | 9/1987 | Radulski et al. |
| 4,702,984 | A | 10/1987 | El-Sayed et al. |
| 4,794,651 | A | 12/1988 | Landa et al. |
| 4,842,974 | A | 6/1989 | Landa et al. |
| 4,845,006 | A | 7/1989 | Matsubara et al. |
| 4,860,924 | A | 8/1989 | Simms et al. |
| 4,957,844 | A | 9/1990 | Page |
| 4,974,027 | A | 11/1990 | Landa et al. |
| 4,980,259 | A | 12/1990 | Landa et al. |
| 4,985,732 | A | 1/1991 | Landa et al. |
| 4,990,424 | A | 2/1991 | Van Dusen et al. |
| 5,001,031 | A | 3/1991 | Yamamoto et al. |
| 5,028,964 | A | 7/1991 | Landa et al. |
| 5,034,778 | A | 7/1991 | Levanon et al. |
| 5,047,306 | A | 9/1991 | Almog |
| 5,047,307 | A | 9/1991 | Landa et al. |
| 5,047,808 | A | 9/1991 | Landa et al. |
| 5,078,504 | A | 1/1992 | Landa et al. |
| 5,089,856 | A | 2/1992 | Landa et al. |
| 5,117,263 | A | 5/1992 | Adam et al. |
| 5,148,222 | A | 9/1992 | Lior et al. |
| 5,157,238 | A | 10/1992 | Landa et al. |
| 5,166,734 | A | 11/1992 | Pinhas et al. |
| 5,176,980 | A | 1/1993 | Santilli et al. |
| 5,192,638 | A | 3/1993 | Landa et al. |
| 5,208,130 | A | 5/1993 | Almog et al. |
| 5,225,306 | A | 7/1993 | Almog et al. |
| 5,230,979 | A | 7/1993 | Chow et al. |
| 5,231,454 | A | 7/1993 | Landa |
| 5,255,058 | A | 10/1993 | Pinhas et al. |
| 5,264,312 | A | 11/1993 | Stolka et al. |
| 5,264,313 | A | 11/1993 | Landa et al. |
| 5,266,435 | A | 11/1993 | Almog |
| 5,268,687 | A | 12/1993 | Peled et al. |
| 5,270,776 | A | 12/1993 | Landa et al. |
| 5,276,492 | A | 1/1994 | Landa et al. |
| 5,278,615 | A | 1/1994 | Landa |
| 5,280,326 | A | 1/1994 | Pinhas et al. |
| 5,286,593 | A | 2/1994 | Landa et al. |
| 5,286,948 | A | 2/1994 | Landa et al. |
| 5,289,238 | A | 2/1994 | Lior et al. |
| 5,300,390 | A | 4/1994 | Landa et al. |
| 5,315,321 | A | 5/1994 | Peled et al. |
| 5,330,872 | A | 7/1994 | Materazzi et al. |
| 5,335,054 | A | 8/1994 | Landa et al. |
| 5,337,131 | A | 8/1994 | Sagiv et al. |
| 5,346,796 | A | 9/1994 | Almog |
| 5,376,491 | A | 12/1994 | Krumberg et al. |
| 5,380,611 | A | 1/1995 | Landa et al. |
| 5,407,771 | A | 4/1995 | Landa et al. |
| 5,410,392 | A | 4/1995 | Landa |
| 5,426,491 | A | 6/1995 | Landa et al. |
| 5,436,706 | A | 7/1995 | Landa et al. |
| 5,442,427 | A | 8/1995 | Day |
| 5,471,287 | A | 11/1995 | Blair et al. |
| 5,497,222 | A | 3/1996 | Landa et al. |
| 5,508,790 | A | 4/1996 | Belinkov et al. |
| 5,527,652 | A | 6/1996 | Krumberg et al. |
| 5,552,875 | A | 9/1996 | Sagiv et al. |
| 5,554,476 | A | 9/1996 | Landa et al. |

(List continued on next page.)

FOREIGN PATENT DOCUMENTS

| | | |
|---|---|---|
| EP | 0 156 408 | 10/1985 |
| EP | 0 305 524 | 3/1989 |
| EP | 0 350 099 | 1/1990 |

(List continued on next page.)

OTHER PUBLICATIONS

Database WPI; Section Ch, Week 198931; Derwent Publications Ltd.; London, GB; Class A04, AN 1989–223001; XP002147328; & JP 01 145666 (RICOH) abstract.

(List continued on next page.)

*Primary Examiner*—Mark A. Chapman
(74) *Attorney, Agent, or Firm*—Fenster & Company

(57) ABSTRACT

Charged toner particles for use in electrostatic imaging, comprising: a toner polymer; and at least one particulate fluorescent material, wherein the toner particles are formed with fibrous extensions.

48 Claims, No Drawings

U.S. PATENT DOCUMENTS

| | | | | |
|---|---|---|---|---|
| 5,554,480 | A | | 9/1996 | Patel et al. |
| 5,555,185 | A | | 9/1996 | Landa |
| 5,557,376 | A | | 9/1996 | Landa et al. |
| 5,558,900 | A | | 9/1996 | Fan et al. |
| 5,558,970 | A | | 9/1996 | Landa et al. |
| 5,570,193 | A | | 10/1996 | Landa et al. |
| 5,571,645 | A | | 11/1996 | Landa |
| 5,572,274 | A | | 11/1996 | Lior et al. |
| 5,585,900 | A | | 12/1996 | Lior et al. |
| 5,592,269 | A | | 1/1997 | Younes et al. |
| 5,596,396 | A | | 1/1997 | Landa et al. |
| 5,610,694 | A | | 3/1997 | Lior et al. |
| 5,629,761 | A | | 5/1997 | Theodoulou et al. |
| 5,636,349 | A | | 6/1997 | Landa et al. |
| 5,655,194 | A | | 8/1997 | Landa et al. |
| 5,701,561 | A | | 12/1997 | Speckhard |
| 5,737,666 | A | | 4/1998 | Lior et al. |
| 5,745,829 | A | | 4/1998 | Gazit et al. |
| 5,749,032 | A | | 5/1998 | Landa et al. |
| 5,759,733 | A | | 6/1998 | Tsubuko et al. |
| 5,792,584 | A | | 8/1998 | Almog |
| 5,793,490 | A | | 8/1998 | Forgacs et al. |
| 5,800,954 | A | | 9/1998 | Kato et al. |
| 5,854,960 | A | | 12/1998 | Tagansky et al. |
| 5,864,353 | A | | 1/1999 | Gila et al. |
| 5,900,003 | A | | 5/1999 | Ben Dror |
| 5,908,729 | A | | 6/1999 | Landa et al. |
| 5,915,152 | A | | 6/1999 | Meiri et al. |
| 5,923,929 | A | | 7/1999 | Ben Avraham et al. |
| 5,933,685 | A | | 8/1999 | Yoo |
| 5,935,754 | A | | 8/1999 | Almog |
| 6,154,226 | A | | 11/2000 | York et al. |
| 6,165,609 | A | * | 12/2000 | Curatolo ..... 428/343 |
| 6,265,883 | B1 | | 7/2001 | Clark |

FOREIGN PATENT DOCUMENTS

| | | |
|---|---|---|
| EP | 0 373 652 | 6/1990 |
| EP | 0 672 967 | 9/1995 |
| GB | 2 029 040 | 3/1980 |
| GB | WO 89/12258 | 3/1980 |
| WO | WO 90/04216 | 4/1990 |
| WO | WO 92/17823 | 10/1992 |
| WO | WO 93/01531 | 1/1993 |
| WO | WO 94/22059 | 9/1994 |
| WO | WO 95/04307 | 2/1995 |
| WO | WO 95/10801 | 4/1995 |
| WO | WO 96/01442 | 1/1996 |
| WO | WO 96/07955 | 3/1996 |
| WO | WO 96/13760 | 5/1996 |
| WO | WO 96/26469 | 8/1996 |
| WO | WO 96/29633 | 9/1996 |
| WO | WO 96/31809 | 10/1996 |
| WO | WO 96/35182 | 11/1996 |
| WO | WO 97/07433 | 2/1997 |
| WO | WO 97/39385 | 10/1997 |
| WO | WO 98/55901 | 12/1998 |
| WO | WO 99/45433 | 9/1999 |
| WO | WO 99/61958 | 12/1999 |
| WO | WO 00/31593 | 6/2000 |
| WO | WO 01/02910 | 1/2001 |
| WO | WO 01/06325 | 1/2001 |

OTHER PUBLICATIONS

Mita Ind Co Ltd; English Abstract of Japanese Patent Document No. JP 63–058356; Orbit Search Service, File WPAT, Accession number 88–1090083/16.

JP 10–166618 A; Jun. 23, 1998; Akihiro, M. & Patent Abstracts of Japan; vol. 1998; No. 11; Sep. 30, 1998.

Database WPI; Week 197631; Derwent Publications Ltd.; London, GB; XP 002152275 & JP 51–069635; Jun. 16, 1973.

* cited by examiner

FLUORESCENT LIQUID TONER AND METHOD OF PRINTING USING SAME

RELATED APPLICATIONS

The present application is a U.S. national application of PCT Application No. PCT/IL00/00277, filed 17 May 2000.

FIELD OF THE INVENTION

The present invention is related to the field of electrostatographic printing and especially to the field of printing using fluorescent toner.

BACKGROUND OF THE INVENTION

Modern liquid toner electrostatic imaging began with the invention of a new class of toners referred to herein as ElectroInk® (which is a trademark of Indigo, N.V. of The Netherlands). This toner is characterized by its comprising toner particles dispersed in a carrier liquid, where the toner particles are comprised of a core of a polymer with fibrous extensions extending from the core. When the toner particles are dispersed in the carrier liquid in a low concentration, the particles remain separate. When the toner develops an electrostatic image the concentration of toner particles increases and the fibrous extensions interlock. A large number of patents and patent applications are directed toward this type of toner and charge directors which are comprised in it. These include: U.S. Pat. Nos. 4,794,651; 4,842,974; 5,047,306; 5,407,307; 5,192,638; 5,208,130; 5,225,306; 5,264,312; 5,266,435; 5,286,593; 5,300,390; 5,346,796; 5,407,771; 5,554;476; 5,655,194; 5,792,584 and 5,5923,929 and PCT Patent publication WO/92/17823, the disclosures of all of which are incorporated herein by reference.

It has been discovered that this type of toner allows for high quality offset printing at high speed. However, this type of printing is described inter alia in patents and patent application numbers 4,678,317; 4,860,924; 4,980,259; 4,985,732; 5,028,964; 5,034,778; 5,047;808; 5,078,504; 5,117,263; 5,148,222; 5,157,238; 5,166,734; 5,208,130; 5,231,454; 5,255,058; 5,266,435; 5,268,687; 5,270,776; 5,276,492; 5,278,615; 5,280,326; 5,286,948; 5,289,238; 5,315,321; 5,335,054; 5,337,131; 5,376,491; 5,380,611; 5,426,491; 5,436,706; 5,497,222; 5,508,790; 5,527,652; 5,552,875; 5,555,185; 5,557,376; 5,558,970; 5,570,193; the disclosures of which are incorporated herein by reference. Systems incorporating various ones of these patents are sold under the names E-Print 1000®, Ominius®, Turbostream™ and Cardpress™.

In general, ElectroInk comprises a polymer or polymers (usually pigmented) which solvate the carrier liquid at some temperature above room temperature (and preferably above normal storage temperatures of 30–40° C.) and do not solvate the carrier liquid or dissolve substantial amounts of it below that temperature. Above the solvation temperature the polymer adsorbs the carrier liquid and is plasticized and softened by it. At elevated temperatures the toner material is thus soft enough to bond with a paper substrate. In practice, the temperature and pressure at which transfer to paper is made are controlled so that the transfer is complete, the transferred toner is fixed to the paper and the image is not squashed.

U.S. Pat. No. 5,908,729, the disclosure of which is incorporated by reference, describes, inter alia, a fluorescent toner, i.e., charged toner particles dispersed in a carrier liquid, where the toner particles are colored with a particulate fluorescent pigment. However, the disclosed toner is not of the type described above. Rather, the pigment is mixed with a low density polyethylene in a planetary mixer. The toner thus formed is not fibrous, but rather is in the form of the particulate material coated with the polyethylene.

SUMMARY OF THE INVENTION

An aspect of some embodiments of the invention is concerned with fluorescent toner having fibrous extensions. In some embodiments of the invention, the fluorescence is provided by particulate fluorescent pigment.

An aspect of some embodiments of the invention is concerned with methods of manufacture of fluorescent toner. In some embodiments of the invention, the toner is manufactured by grinding a mixture of thermoplastic polymer material, fluorescent pigment and carrier liquid to form the toner particles. The toner particles will then generally have fibrous extensions.

An aspect of some embodiments of the invention is concerned with toner particles comprising a fluorescent pigment material and another colorant. The other colorant may be a pigment, or a dye. The other colorant may have a relatively strong color and a weak or no fluorescence. The fluorescent pigment may have strong fluorescence and relatively weal, "normal" color. In addition, the fluorescent pigment may have a different hue from other pigment.

One type of useful pigment is particles of a fluorescent dye dissolved in a rigid solid polymer matrix. This type of pigment is generally optimized for high fluorescence, by providing an optimum dilution of the dye and an environment that has relatively low quenching of the fluorescence, while environmentally protecting the dye. Examples of such polymer matrices are formaldehyde resins. However, other resins, including thermosetting resins are known for producing such pigments.

Generally, the pigments have a size of 2–4 micrometers, although larger and smaller sized particles can be used. This is as large as, or larger than ElectroInk produced with normal pigment, which is much smaller than the fluorescent pigments. Toner particles utilizing the fluorescent toner have a particle size, generally depending on the size of the pigment, of 3 to 10 micrometers, more generally between 5 and 9 micrometers. This size may vary to an even greater extent, especially when very large or small pigments are used.

There is also provided, in accordance with some embodiments of the invention, Charged toner particles for use in electrostatic imaging, comprising: a toner polymer; and at least one particulate fluorescent material, wherein the toner particles are formed with fibrous extensions.

In an embodiment of the invention, the particles include a pigment additional to the at least one particulate fluorescent material.

There is further provided, in accordance with some embodiments of the invention, charged toner particles for use in electrostatic imaging, comprising: a toner polymer, at least one particulate fluorescent material; and a pigment, additional to the particulate fluorescent material.

In exemplary embodiments of the invention, the additional pigment is an organic pigment. In some embodiments the additional pigment is fluorescent; in others it is not fluorescent. In some embodiments of the invention, the fluorescent color of the at least one particulate fluorescent material is different from that of the pigment. In exemplary embodiments of the invention, the at least one particulate material and the pigment is greater than about 30% by weight of the total dry solids of the toner particle. In others it is greater than about 40% or 45% by weight of the total dry solids of the toner particle.

In exemplary embodiments of the invention, the particulate fluorescent material comprises an encapsulated dye material. In some embodiments the dye material is encapsulated in an encapsulating polymer, such as a thermoplastic polymer, or a thermosetting polymer.

In some exemplary embodiments of the invention, the particulate fluorescent particulate material is in the form of pigment particles having a size greater than about 2, 3, or 4 micrometers.

In some exemplary embodiments of the invention, the toner particle size is greater than about 3 or 5 micrometers. In some exemplary embodiments, the toner particle size is smaller than about 9 or 10 micrometers.

In exemplary embodiments of the invention, the particulate fluorescent material comprises more than 40% or 50% of the non-volatile solids portion of the particle.

In some exemplary embodiments of the invention, the toner polymer comprises an ethylene methacrylic acid copolymer.

There is further provided, in accordance with some embodiments of the invention, a liquid toner, comprising: a carrier liquid; and charged toner particles according to any of the preceding claims dispersed in the carrier liquid.

In exemplary embodiments of the invention, the carrier liquid is substantially non-conducting.

In exemplary embodiments of the invention, the liquid toner includes a charge director for aiding in the charging of the toner particles.

There is further provided, in accordance with some embodiments of the invention, a method of producing a liquid toner comprising:

mixing a toner polymer, a carrier liquid and a particulate fluorescent material;

grinding the mixture until toner particles are produced.

In some embodiments, mixing comprises mixing a pigment additional to the at least one particulate fluorescent material with the other materials.

There is further provided, in accordance with some embodiments of the invention, a method of producing a liquid toner comprising:

mixing a toner polymer, a carrier liquid, a particulate fluorescent material and a pigment in addition to the particulate fluorescent material;

grinding the mixture until toner particles are produced.

In some embodiments of the invention, the additional pigment is an organic pigment. In some embodiments, the additional pigment is fluorescent. In others, the pigment is not fluorescent. In some embodiments of the invention, the fluorescent color of the at least one particulate fluorescent is different from that of the additional pigment.

In exemplary embodiments of the invention, the at least one particulate material and the pigment is greater than about 30, 40 or 45% by weight of the total dry solids of the mixture.

In exemplary embodiments particulate fluorescent material comprises an encapsulated dye material. In some embodiments the dye material is encapsulated in an encapsulating polymer, which in some embodiments is a thermoplastic polymer and in others is a thermosetting polymer.

In some exemplary embodiments of the invention, the particulate fluorescent particulate material is in the form of pigment particles having a size greater than about 2, 3, or 4 micrometers.

In some exemplary embodiments of the invention, the toner particle size is greater than about 3 or 5 micrometers. In some exemplary embodiments, the toner particle size is smaller than about 9 or 10 micrometers.

In exemplary embodiments of the invention, the particulate fluorescent material comprises more than 40%, 50% or more of the non-volatile solids portion of the particle.

In some embodiments, the toner polymer comprises an ethylene methacrylic acid copolymer.

In some embodiments of the invention, the method includes choosing the conditions of grinding and the toner polymer such that the toner particles are formed with fibrous extensions.

In some embodiments of the invention, mixing comprises:

first plasticizing the toner polymer with the carrier liquid; and subsequently adding additional carrier liquid and particulate fluorescent material.

There is further provided, in accordance with some embodiments of the invention, a printing method, comprising:

providing an electrostatic image;

developing the image with toner particles or a liquid toner according to the invention or a toner produced in accordance with the invention to form a visible image.

In exemplary embodiments of the invention, the method includes transferring the developed image to a final substrate. In some embodiments transferring the developed image to a final substrate comprises:

transferring the developed image to an intermediate transfer member; and subsequently transferring the developed image to the final substrate.

DETAILED DESCRIPTION OF EXEMPLARY EMBODIMENTS

Non-Limiting Examples of Toners

A first exemplary toner, in accordance with an embodiment of the invention, can be prepared by:

(1) Loading 1400 grams of Nucrel 699 resin (an ethylene methacrylic acid copolymer by Dupont), and 2600 grams of Isopar-L (an Isoparaffinic hydrocarbon distributed by Exxon) in a Ross double planetary mixer type 312-VI-031-089, preheated by a heating bath, set to 130° C. The ingredients are mixed for about ½ hour at speed control setting 2. The speed is increased to a speed setting of 3 for 60 minutes, then to a speed setting of 6 for 1 hour. The heating is stopped and the mixer is cooled with a fan while mixing is continued at a speed setting of 4 for 1.5 hours followed by mixing at a speed setting of 2 until the temperature reaches 40° C. The result is a pasty material, having a non-volatile solids weight percentage of about 35%. The material is diluted to a 23% solids content by the addition of a further quantity of Isopar-L.

(2) 76.4 grams of the resulting 23% solids mixture, together with 0.43 grams of aluminum streate and 105.17 grams of Isopar L, is loaded into a S0 ball mill (Union Process) with 3/16" chrome steel grinding media, together with 18 grams of pigment of one of the types described below. The speed is set near the maximum available.

The material is ground at 40° C. for 1 hour, followed by additional grinding at 30° C. for 19 hours. The result is discharged from the mill and mixed with an amount of Isopar L to form a working dispersion at 3.5% solids. The toner particles have fibrous extensions and a size of between 5 micrometers and 9 micrometers as measured in a Coulter LS 200 type particle size meter.

The toner is charged utilizing a charge director, for example, a charge director described in the above referenced U.S. Pat. No. 5,346,796 and containing 30 parts by weight lecithin, 30 parts by weight BBP and 6 parts by weight G3300 as a stabilizer. The charge director, dissolved in Isopar-L is added in an amount of about 25–40 mg of solids of the charge director per gram of toner solids. A small amount of Marcol 82 may be added to carrier liquid to form a mixed carrier liquid, as described in the above references.

The following pigments have been successfully used as pigments for fluorescent pink toners. These are JST 17 (Radiant Color) pink toner, having a 2 micrometer size, Astral Pink A1 Seria FEX (Fiesta) having a 2 micrometer size and Astral Pink A-1 Seria "A" (Fiesta) having a 4 micrometer size. These resulted in a measured particles size of between 6.85 and 7 micrometers. It is noted that the smaller pigment particles give a higher OD and reflection. Surprisingly, the grinding process does not appear to reduce the fluorescence, either because the integrity of the pigment is not destroyed or because size reduction of the pigment is not effective to reduce the fluorescent effects.

These toners have a pink color. The toners described above have an OD of between 0.28–0.90 and percentage reflectance of between 122 and 144 for developed mass of between 0.1 and 0.2 mg of dry toner/cm$^2$, with the smaller particles giving the higher values and JST 17 giving the highest values among the three types. These thicknesses are typical also of the thicknesses of toner achieved using standard ElectroInk on the same machine.

The OD is measured using a standard X-Rite 408 densitometer (setting G), after: calibration utilizing the procedure described in the manual for the device. The OD value is the amount of maximum reflection through an appropriate filter. The reflectance curve can be obtained using an X-Rite 968 or 938 spectrometer. The data generated includes reflectance values of the specimen at a range of 400–700 nm.

The result is a pink toner having a relatively high pigment concentration. It is noted that in order to achieve adequate image brightness, a very high pigment loading is desirable. In essence, the pigment loading for the above examples is about 50%. However, it is believed that, depending on the pigment used, 30–60% pigment loading will be optimum, although other values can be used as well.

For some colors of pigment, even these high pigment loadings of encased dye pigments is not sufficient to provide high enough OD. In accordance with another exemplary embodiment of the invention, two types of pigments are used. The first of these is the encased dye pigment. The other is second pigment which may be, for example an organic pigment, such as an aldezine pigment. The second pigment may be fluorescent, but is generally not an encased dye.

A second exemplary toner, in accordance with an embodiment of the invention, can be prepared by performing the following after (1) from the previous example:

(2) 954 grams of the resulting 23% solids mixture, together with 108.1 grams of Lumogen S0790 yellow pigment (aldazine yellow by BASF), 72.08 grams JST-10 (yellow fluorescent encased pigment-Radiant Color), 14.41 grams of JST 12 (fluorescent orange) and 1151.4 grams of Isopar L, is loaded into a S1 ball mill (Union Process) with 3/16" chrome steel grinding media. The Lumogen pigment is fluorescent.

The material is ground at 58° C. for 1 hour, followed by additional grinding at 40° C. for 19 hours at 250 RPM. The result is discharged from the mill and mixed with an amount of Isopar L to form a working dispersion at 3.5% solids. The toner particles have fibrous extensions and a size of about 7 micrometers as measured in a Coulter LS 200 type particle size meter.

The toner is charged utilizing a charge director, for example, a charge director described in the above referenced U.S. Pat. No. 5,346,796 and containing 30 parts by weight lecithin, 30 parts by weight BBP and 6 parts by weight G3300 as a stabilizer. The charge director, dissolved in Isopar-L is added in an amount of about 10–30 mg of solids of the charge director per gram of toner solids. A small amount of Marcol 82 may be added to carrier liquid to form a mixed carrier liquid, as described in the above references.

This toner has a yellow color with an orange hue. The total pigment loading by weight of solids is 47%, with 44.4% of the total pigment (20.9% of total solids) being of the encased dye type.

For a yellow toner with a green hue the following procedure is followed:

(2) 1044 grams of the resulting mixture, together with 110.75 grams of Lurnogen S0790 yellow pigment (aldazine yellow by BASF), 42.44 grams JST-10, 20.7 grams of JST 31 (fluorescent green) and 1082.11 grams of Isopar L, is loaded into a S1 ball mill (Union Process) with 3/16" chrome steel grinding media.

The material is ground at 40° C. for 20 hours. The result is discharged from the mill and mixed with an amount of Isopar L to form a working dispersion at 2% solids. The toner particles have fibrous extensions and a size of about 8.6 micrometers as measured in a Coulter LS 200 type particle size meter.

Charging and dilution of the result is carried out as above.

The total pigment loading by weight of solids is 42%, with 36.3% of the total pigment (15.3% of the total solids) being of the encased dye type.

Of course, a yellow toner in which the fluorescent color was also yellow could have been made by the same method by deleting the orange or green fluorescent pigment and increasing the amount of JST-10 pigment.

It should be understood that the above examples are experimental toners that were; produced on an experimental basis. Neither the process nor the colors were optimized. Variations on the measured values may be expected between batches. Other ratios of pigments and various pigment colors may be used to achieve different colors and effects. In addition, pigments of different types may be used, such as the PC series (3 micrometers thermoplastic polymer encapsulation) and PC series (3 micrometers thermosetting polymer encapsulation) of Radiant Color. Other, larger or smaller pigments may be used.

It will be further understood that many variations of the toners according to the: invention are possible and the toners that are defined by the claims may be produced using a wide variety of polymers. In particular, other ethylene methacrylic acid copolymers and ionomers and esters of ethylene methacrylic acid copolymers of various molecular weights may be used in place of Nucrel 966. In some preferred embodiments of the invention low molecular weight ethylene acrylic acid copolymers and/or their ionomers and esters and/high molecular weight ethylene polymers with high acid functionality sold under the trade name of ELVAX, by Dupont may be substituted for the resin indicated above. Other charge directors, as known in the art may also be used.

The toner is useful for printing utilizing substantially conventional systems as described in the above referenced patents and applications, in which various electrostatic images are sequentially formed on a photoreceptor. A same conventional roller developer is used for developing all of the separations by introduction of a low toner particle concentration liquid toner (such as 3.5%) in the space between the developer roller and the photoreceptor. Such systems include the above referenced E-Print 1000®, Ominius®, Turbostream™ and Cardpress™.

It is also believed to be useful in printers of the type described in PCT published applications WO 93/01531 and WO 95/10801 and PCT application PCT/IL98/00553.

While the above referenced printers utilize an intermediate transfer member, the invention is also useful in printers in which the toner is transferred directly from an imaging plate (such as a photoreceptor) to a final substrate.

While a number of different embodiments have been shown, details of one embodiment of the invention may, where applicable, in other embodiments. Similarly, some details shown in the embodiments, while preferred, are not essential and some preferred embodiments of the invention may omit them.

As used herein, the terms "have", "include" and "comprise" or their conjugates, as used herein mean "including but not limited to".

What is claimed is:

1. Charged toner particles for use in electrostatic imaging, comprising:

a toner polymer; and at least one particulate fluorescent material, wherein the toner particles are formed with fibrous extensions.

2. A liquid toner, comprising:

a carrier liquid; and charged toner particles dispersed in the carrier liquid, said charged particles comprising:

a toner polymer; and at least one particulate fluorescent material, wherein the toner particles are formed with fibrous extensions.

3. A liquid toner according to claim 2 wherein the carrier liquid is substantially non-conducting.

4. A liquid toner according to claim 2, including a charge director for aiding in the charging of the toner particles.

5. A printing method, comprising:

providing an electrostatic image;

developing the image with a toner according to claim 2.

6. A method according to claim 5 and including:

transferring the developed image to a final substrate.

7. A method according to claim 6 wherein transferring the developed image to a final substrate comprises:

transferring the developed image to an intermediate transfer member; and subsequently transferring the developed image to the final substrate.

8. A liquid toner according to claim 2 wherein the charged toner particles comprise a pigment additional to the at least one particulate fluorescent material.

9. A liquid toner according to claim 8 wherein the additional pigment is fluorescent.

10. A liquid toner according to claim 8 wherein the additional pigment is not fluorescent.

11. A liquid toner according to claim 8 wherein the fluorescent color of the at least one particulate fluorescent material is different from that of the additional pigment.

12. A liquid toner according to claim 8 wherein the at least one particulate fluorescent material and the additional pigment is greater than about 30% by weight of the total dry solids of the toner particle.

13. A liquid toner according to claim 8 wherein the at least one particulate fluorescent material and the additional pigment is greater than about 40% by weight of the total dry solids of the toner particle.

14. A liquid toner according to claim 2 wherein the particulate fluorescent material comprises an encapsulated dye material.

15. A liquid toner according to claim 14 wherein the dye material is encapsulated in an encapsulating polymer.

16. A liquid toner according to claim 15 wherein the encapsulating polymer is a thermoplastic polymer.

17. A liquid toner according to claim 15 wherein the encapsulating polymer is a thermosetting polymer.

18. A liquid toner according to claim 2 wherein the particulate fluorescent particulate material is in the form of pigment particles having a size greater than about 2 micrometers.

19. A liquid toner according to claim 2 wherein the particulate fluorescent particulate material is in the form of pigment particles having a size greater than about 3 micrometers.

20. A liquid toner according to claim 2 wherein the particulate fluorescent particulate material is in the form of pigment particles having a size of 4 micrometers or more.

21. A liquid toner according to claim 2 wherein the toner particle size is greater than about 3 micrometer.

22. A liquid toner according to claim 2 wherein the toner particle size is greater than about 5 micrometers.

23. A liquid toner according to claim 2 wherein the toner particle size is smaller than about 10 micrometers.

24. A liquid toner according to claim 2 wherein the toner particle size is smaller than about 9 micrometers.

25. A liquid toner according to claim 2 wherein the particulate fluorescent material comprises more than 40% of the non-volatile solids portion of the particle.

26. A liquid toner according to claim 25 wherein the particulate fluorescent material comprises more than 50% of the non-volatile solids portion of the particle.

27. A liquid toner according to claim 2 wherein the toner polymer comprises an ethylene methacrylic acid copolymer.

28. A method of producing a liquid toner comprising:

mixing a toner polymer, a carrier liquid and particulate fluorescent material; and grinding the mixture until toner particles are produced, including choosing the conditions of grinding and the toner polymer such that the toner particles are formed with fiberous extensions.

29. A method according to claim 28 wherein mixing comprises mixing a pigment additional to the at least one particulate fluorescent material with the other materials.

30. A method according to claim 29 wherein the additional pigment is fluorescent.

31. A method according to claim 29 wherein the additional pigment is not fluorescent.

32. A method according to claim 29 wherein the fluorescent color of the at least one particulate fluorescent material is different from that of the additional pigment.

33. A method according to claim 29 wherein the at least one particulate fluorescent material and the additional pigment is greater than about 30% by weight of the total dry solids of the mixture.

34. A method according to claim 33 wherein the at least one particulate fluorescent material and the additional pigment is greater than about 45% by weight of the total dry solids of the toner particle.

35. A method according to claim 28 wherein the particulate fluorescent material comprises an encapsulated dye material.

36. A method according to claim 35 wherein the dye material is encapsulated in an encapsulating polymer.

37. A method according to claim 36 wherein the encapsulating polymer is a thermoplastic polymer.

38. A method according to claim 36 wherein the encapsulating polymer is a thermosetting polymer.

39. A method according to claim 28 wherein the particulate fluorescent particulate material is in the form of pigment particles having a size greater than about 2 micrometers.

40. A method according to claim 28 wherein the grinding is continued until the toner particle size is smaller than about 10 micrometers.

41. A method according to claim 28 wherein the grinding is interrupted while the particle size is greater than about 3 micrometers.

42. A method according to claim 28 wherein the grinding is interrupted while the particle size is greater than about 5 micrometers.

43. A method according to claim 28 wherein the particulate fluorescent particulate material is in the form of pigment particles having a size greater than about 3 micrometers.

44. A method according to claim 28 wherein the toner particle size is smaller than about 5 micrometer.

45. A method according to claim 28 wherein the particulate fluorescent material comprises more than 40% of the non-volatile solids portion of the mixture.

46. A method according to claim 45 wherein the particulate fluorescent material comprises more than 50% of the non-volatile solids portion of the mixture.

47. A method according to claim 28 wherein the toner polymer comprises an ethylene methacrylic acid copolymer.

48. A method according to claim 28 wherein mixing comprises:

first plasticizing the toner polymer with the carrier liquid; and subsequently adding additional carrier liquid and particulate fluorescent material.

* * * * *